US009322367B2

(12) United States Patent
Vigild et al.

(10) Patent No.: US 9,322,367 B2
(45) Date of Patent: Apr. 26, 2016

(54) METHODS AND SYSTEMS FOR FUEL CANISTER PURGE FLOW ESTIMATION WITH AN INTAKE OXYGEN SENSOR

(71) Applicant: Ford Global Technologies, LLC, Dearborn, MI (US)

(72) Inventors: Christian Winge Vigild, Aldenhoven (DE); Julia Helen Buckland, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 311 days.

(21) Appl. No.: 14/155,261

(22) Filed: Jan. 14, 2014

(65) Prior Publication Data

US 2015/0198122 A1 Jul. 16, 2015

(51) Int. Cl.
*F02M 25/07* (2006.01)
*F02M 25/08* (2006.01)

(52) U.S. Cl.
CPC ..... *F02M 25/0836* (2013.01)

(58) Field of Classification Search
CPC ..... B60K 15/03; B60K 11/085; B60K 2015/0319; F02M 25/0827; F02M 2015/0881; F02M 25/089
USPC ..... 123/568.11, 568.21, 568.25; 60/274–278, 285, 299
See application file for complete search history.

(56) References Cited

U.S. PATENT DOCUMENTS 4,601,273 A 7/1986 Kitahara et al.
5,392,598 A 2/1995 White et al.
6,182,498 B1 2/2001 Mizutani et al.
6,739,177 B2 5/2004 Sato et al.
6,742,379 B2 6/2004 Matsubara et al.
8,312,765 B2 11/2012 Pursifull et al.
8,392,098 B2 3/2013 Yamashita
8,522,760 B2 9/2013 Soltis
9,188,087 B2 * 11/2015 Surnilla ..... F02M 25/089
2011/0094219 A1 4/2011 Palm
2012/0152210 A1 6/2012 Reddy et al.
2014/0114550 A1 * 4/2014 Bohr ..... F02D 41/0037 701/102

(Continued)

FOREIGN PATENT DOCUMENTS

EP 0005613 A2 11/1979
EP 0844380 B1 3/2003

OTHER PUBLICATIONS

Surnilla, Gopichandra et al., "Methods and Systems for Humidity Detection Via an Exhaust Gas Sensor," U.S. Appl. No. 13/745,639, filed Jan. 18, 2013, 32 pages.

(Continued)

*Primary Examiner* — John Kwon
(74) *Attorney, Agent, or Firm* — Julia Voutyras; Alleman Hall McCoy Russell & Tuttle LLP

(57) ABSTRACT

Methods and systems are provided for estimating a fuel canister purge flow based on outputs of an intake manifold oxygen sensor. For example, during boosted engine operation when exhaust gas recirculation (EGR) is flowing below a threshold and purge is enabled, purge flow may be estimated based on changes in the sensor output while modulating a canister purge valve between an open and closed position. Then, during subsequent operation wherein EGR and purge flow are enabled, the output of the sensor may be adjusted based on the estimated purge flow.

20 Claims, 6 Drawing Sheets

(56) References Cited

U.S. PATENT DOCUMENTS

| | | | | |
|---|---|---|---|---|
| 2014/0251285 | A1* | 9/2014 | Surnilla | F02B 47/08 123/520 |
| 2015/0120133 | A1* | 4/2015 | Dudar | F02M 65/00 701/34.4 |
| 2015/0121864 | A1* | 5/2015 | Surnilla | F02D 41/0052 60/605.2 |

OTHER PUBLICATIONS

Surnilla, Gopichandra et al., "Intake Air Oxygen Compensation for EGR," U.S. Appl. No. 13/789,182, filed Mar. 7, 2013, 32 pages.
Pursifull, Ross Dykstra, "Methods and Systems for an Oxygen Sensor," U.S. Appl. No. 13/849,402, filed Mar. 22, 2013, 24 pages.
Surnilla, Gopichandra et al., "Methods and Systems for an Intake Oxygen Sensor," U.S. Appl. No. 14/032,109, filed Sep. 19, 2013, 44 pages.
Surnilla, Gopichandra et al., "Methods and Systems for an Oxygen Sensor," U.S. Appl. No. 14/052,641, filed Oct. 11, 2013, 55 pages.
Surnilla, Gopichandra et al., "Methods and Systems for an Intake Oxygen Sensor," U.S. Appl. No. 14/052,633, filed Oct. 11, 2013, 39 pages.
Surnilla, Gopichandra et al., "Methods and Systems for an Oxygen Sensor," U.S. Appl. No. 14/052,637, filed Oct. 11, 2013, 55 pages.
Surnilla, Gopichandra et al., "Methods and Systems for an Oxygen Sensor," U.S. Appl. No. 14/052,635, filed Oct. 11, 2013, 55 pages.
Surnilla, Gopichandra et al., "Methods and Systems for an Intake Oxygen Sensor," U.S. Appl. No. 14/032,103, filed Sep. 19, 2013, 43 pages.
Surnilla, Gopichandra et al., "Methods and Systems for PCV Flow Estimation With an Intake Oxygen Sensor," U.S. Appl. No. 14/073,480, filed Nov. 6, 2013, 52 pages.

* cited by examiner

METHODS AND SYSTEMS FOR FUEL CANISTER PURGE FLOW ESTIMATION WITH AN INTAKE OXYGEN SENSOR

FIELD

The present application relates generally to a gas constituent sensor included in an intake system of an internal combustion engine.

BACKGROUND/SUMMARY

Engine systems may utilize recirculation of exhaust gas from an engine exhaust system to an engine intake system (intake passage), a process referred to as exhaust gas recirculation (EGR), to reduce regulated emissions and/or improve fuel economy. An EGR system may include various sensors to measure and/or control the EGR. As one example, the EGR system may include an intake gas constituent sensor, such as an oxygen sensor, which may be employed during non-EGR conditions to determine the oxygen content of fresh intake air. During EGR conditions, the sensor may be used to infer EGR based on a change in oxygen concentration due to addition of EGR as a diluent. One example of such an intake oxygen sensor is shown by Matsubara et al. in U.S. Pat. No. 6,742,379. The EGR system may additionally or optionally include an exhaust gas oxygen sensor coupled to the exhaust manifold for estimating a combustion air-fuel ratio.

As such, due to the location of the oxygen sensor downstream of a charge air cooler in the high pressure air induction system, the sensor may be sensitive to the presence of fuel vapor and other reductants and oxidants such as oil mist. For example, during boosted engine operation, purge air may be received at a compressor inlet location. Hydrocarbons ingested from purge air, positive crankcase ventilation (PCV) and/or rich EGR can consume oxygen on the sensor catalytic surface and reduce the oxygen concentration detected by the sensor. In some cases, the reductants may also react with the sensing element of the oxygen sensor. The reduction in oxygen at the sensor may be incorrectly interpreted as a diluent when using the change in oxygen to estimate EGR. Thus, the sensor measurements may be confounded by the various sensitivities, and the accuracy of the sensor, and thus, measurement and/or control of EGR, may be reduced.

In one example, some of the above issues may be addressed by a method for an engine comprising: during boosted engine operation with exhaust gas recirculation (EGR) flowing below a first threshold, modulating a canister purge valve (CPV) and estimating a purge flow rate based on an output of an intake oxygen sensor responsive to the modulating, the first threshold based on a response time of the CPV. In this way, an EGR estimate provided by the intake oxygen sensor can be corrected for the purge flow content.

For example, during boosted engine operation when EGR is flowing and purge flow is enabled (e.g., the CPV is open), purge flow vapors may cause a decrease in the intake oxygen measured by the intake oxygen sensor. Therefore, when the engine is boosted and EGR is flowing, a CPV may be modulated and the purge flow rate may be estimated based on the output of the intake oxygen sensor during the modulating. Specifically, an engine controller may open and close the CPV at a set frequency. The frequency may be based on a determined fuel canister load and a sensitivity of the intake oxygen sensor. Additionally, before modulating the CPV, the controller may decrease the EGR flow rate below a threshold, the threshold based on the modulating frequency. Estimating the purge flow during the modulating includes determining a change in intake oxygen measured by the intake oxygen sensor during the modulating (e.g., the change in intake oxygen between open and closed positions of the CPV) and then converting the change in intake oxygen to equivalent hydrocarbons. The estimated purge flow rate may then be used to correct the output of the intake oxygen sensor for purge flow, thereby eliminating the effect of purge on the intake oxygen measurement and resulting in a more accurate EGR estimate. Specifically, an engine controller may adjust the output of the intake oxygen sensor by the learned change in intake oxygen due to purge (e.g., purge correction factor). The adjusted output may be the change in intake oxygen due to EGR alone and not purge. Thus, the resulting EGR flow estimate may be more accurate and be used to adjust the EGR valve to deliver the desired EGR flow.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
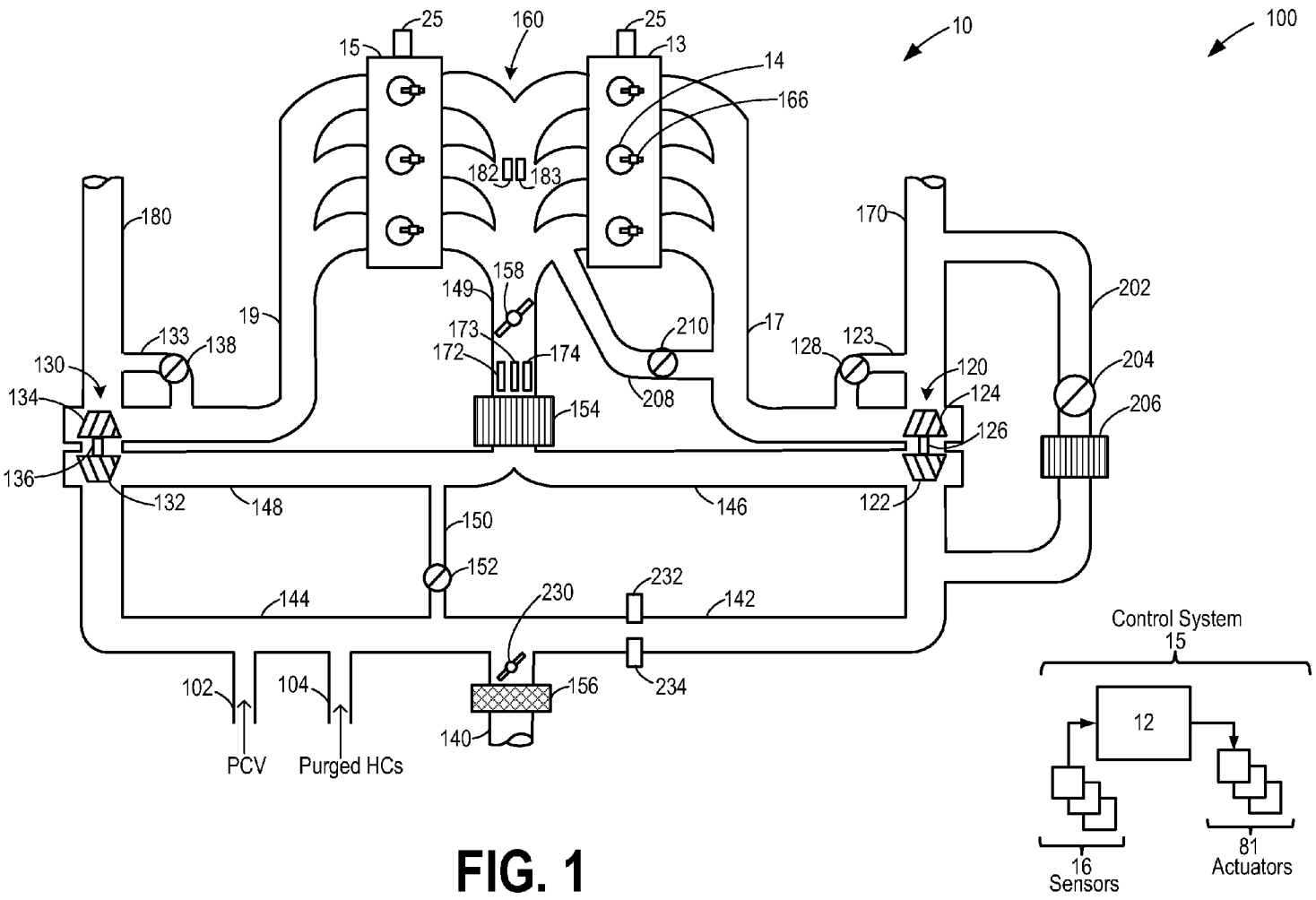
FIGS. 1-2 are schematic diagrams of an engine system.
Figure 2:
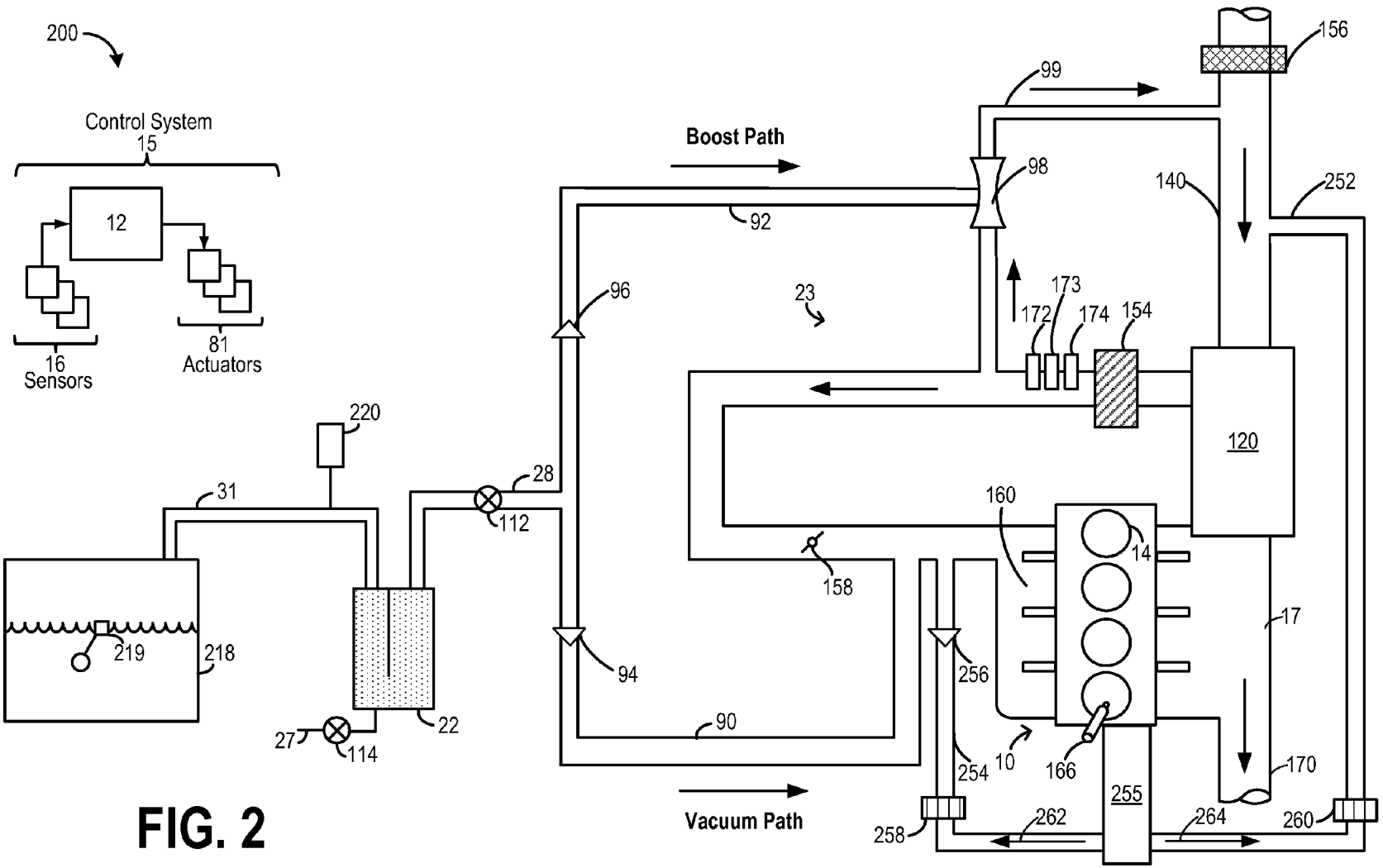
Figure 3:
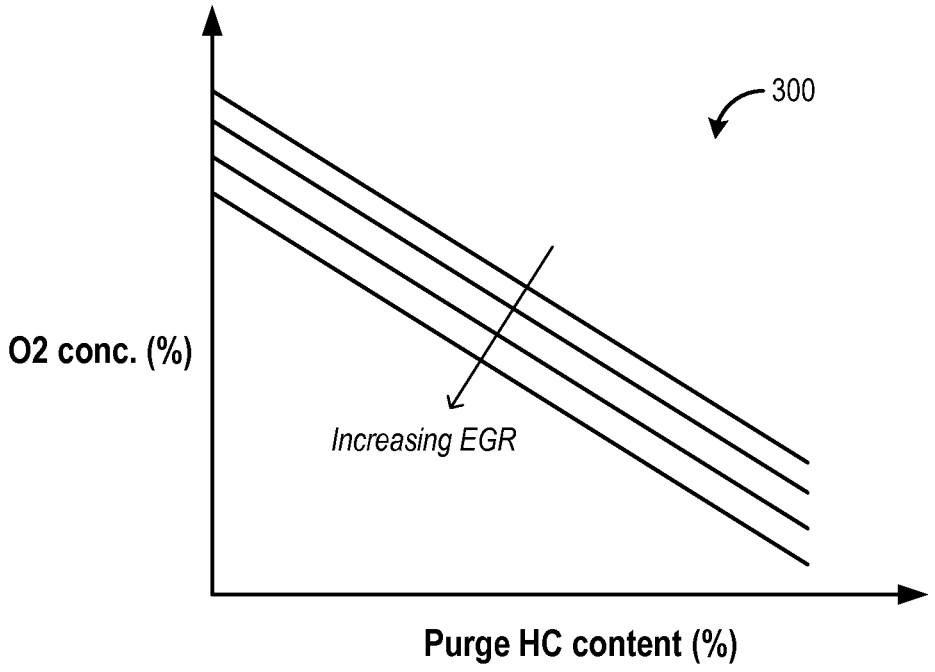
FIG. 3 is a map depicting the impact of purge air on the oxygen concentration estimated by an intake manifold oxygen sensor.

The following description relates to methods and system for using an intake manifold sensor for sensing an amount of EGR flow to an engine system, such as the engine systems of FIGS. 1-2. A fuel canister purge valve may be modulated during boosted engine operation in order to determine the impact of purge hydrocarbons on an output of an intake oxygen sensor. A controller may be configured to perform a control routine, such as the routine of FIGS. 4-5 to learn an amount of purge hydrocarbons ingested into an engine and adjust an EGR flow accordingly. Example adjustments to the fuel canister purge valve for determining purge flow with the intake oxygen sensor are shown at FIG. 6. An output of the sensor, as well as an EGR dilution estimated by the sensor, may be adjusted to compensate for the effect of purge hydrocarbons on the output of the sensor (FIG. 3). In this way, accuracy of EGR estimation by an intake oxygen sensor is increased.

FIG. 1 shows a schematic depiction of an example turbocharged engine system 100 including a multi-cylinder internal combustion engine 10 and twin turbochargers 120 and 130. As one non-limiting example, engine system 100 can be included as part of a propulsion system for a passenger vehicle. Engine system 100 can receive intake air via intake passage 140. Intake passage 140 can include an air filter 156 and an EGR throttle valve 230. Engine system 100 may be a split-engine system wherein intake passage 140 is branched downstream of EGR throttle valve 230 into first and second parallel intake passages, each including a turbocharger compressor. Specifically, at least a portion of intake air is directed to compressor 122 of turbocharger 120 via a first parallel intake passage 142 and at least another portion of the intake air is directed to compressor 132 of turbocharger 130 via a second parallel intake passage 144 of the intake passage 140.

The first portion of the total intake air that is compressed by compressor 122 may be supplied to intake manifold 160 via first parallel branched intake passage 146. In this way, intake passages 142 and 146 form a first parallel branch of the engine's air intake system. Similarly, a second portion of the total intake air can be compressed via compressor 132 where it may be supplied to intake manifold 160 via second parallel branched intake passage 148. Thus, intake passages 144 and 148 form a second parallel branch of the engine's air intake system. As shown in FIG. 1, intake air from intake passages 146 and 148 can be recombined via a common intake passage 149 before reaching intake manifold 160, where the intake air may be provided to the engine.

A first EGR throttle valve 230 may be positioned in the engine intake upstream of the first and second parallel intake passages 142 and 144, while a second air intake throttle valve 158 may be positioned in the engine intake downstream of the first and second parallel intake passages 142 and 144, and downstream of the first and second parallel branched intake passages 146 and 148, for example, in common intake passage 149.

In some examples, intake manifold 160 may include an intake manifold pressure sensor 182 for estimating a manifold pressure (MAP) and/or an intake manifold temperature sensor 183 for estimating a manifold air temperature (MCT), each communicating with controller 12. Intake passage 149 can include a charge air cooler (CAC) 154 and/or a throttle (such as second throttle valve 158). The position of throttle valve 158 can be adjusted by the control system via a throttle actuator (not shown) communicatively coupled to controller 12. An anti-surge valve 152 may be provided to selectively bypass the compressor stages of turbochargers 120 and 130 via bypass passage 150. As one example, anti-surge valve 152 can open to enable flow through bypass passage 150 when the intake air pressure downstream of the compressors attains a threshold value.

Intake manifold 160 may further include an intake gas oxygen sensor 172. In one example, the oxygen sensor is a UEGO sensor. As elaborated herein, the intake gas oxygen sensor may be configured to provide an estimate regarding the oxygen content of fresh air received in the intake manifold. In addition, when EGR is flowing, a change in oxygen concentration at the sensor may be used to infer an EGR amount and used for accurate EGR flow control. In the depicted example, oxygen sensor 172 is positioned upstream of throttle 158 and downstream of charge air cooler 154. However, in alternate embodiments, the oxygen sensor may be positioned upstream of the CAC. A pressure sensor 174 may be positioned alongside the oxygen sensor for estimating an intake pressure at which an output of the oxygen sensor is received. Since the output of the oxygen sensor is influenced by the intake pressure, a reference oxygen sensor output may be learned at a reference intake pressure. In one example, the reference intake pressure is a throttle inlet pressure (TIP) where pressure sensor 174 is a TIP sensor. In alternate examples, the reference intake pressure is a manifold pressure (MAP) as sensed by MAP sensor 182.

Engine 10 may include a plurality of cylinders 14. In the depicted example, engine 10 includes six cylinders arrange in a V-configuration. Specifically, the six cylinders are arranged on two banks 13 and 15, with each bank including three cylinders. In alternate examples, engine 10 can include two or more cylinders such as 3, 4, 5, 8, 10 or more cylinders. These various cylinders can be equally divided and arranged in alternate configurations, such as V, in-line, boxed, etc. Each cylinder 14 may be configured with a fuel injector 166. In the depicted example, fuel injector 166 is a direct in-cylinder injector. However, in other examples, fuel injector 166 can be configured as a port based fuel injector.

Intake air supplied to each cylinder 14 (herein, also referred to as combustion chamber 14) via common intake passage 149 may be used for fuel combustion and products of combustion may then be exhausted from via bank-specific parallel exhaust passages. In the depicted example, a first bank 13 of cylinders of engine 10 can exhaust products of combustion via a first parallel exhaust passage 17 and a second bank 15 of cylinders can exhaust products of combustion via a second parallel exhaust passage 19. Each of the first and second parallel exhaust passages 17 and 19 may further include a turbocharger turbine. Specifically, products of combustion that are exhausted via exhaust passage 17 can be directed through exhaust turbine 124 of turbocharger 120, which in turn can provide mechanical work to compressor 122 via shaft 126 in order to provide compression to the intake air. Alternatively, some or all of the exhaust gases flowing through exhaust passage 17 can bypass turbine 124 via turbine bypass passage 123 as controlled by wastegate 128. Similarly, products of combustion that are exhausted via exhaust passage 19 can be directed through exhaust turbine 134 of turbocharger 130, which in turn can provide mechanical work to compressor 132 via shaft 136 in order to provide compression to intake air flowing through the second branch of the engine's intake system. Alternatively, some or all of the exhaust gas flowing through exhaust passage 19 can bypass turbine 134 via turbine bypass passage 133 as controlled by wastegate 138.

In some examples, exhaust turbines 124 and 134 may be configured as variable geometry turbines, wherein controller 12 may adjust the position of the turbine impeller blades (or vanes) to vary the level of energy that is obtained from the exhaust gas flow and imparted to their respective compressor. Alternatively, exhaust turbines 124 and 134 may be configured as variable nozzle turbines, wherein controller 12 may adjust the position of the turbine nozzle to vary the level of energy that is obtained from the exhaust gas flow and imparted to their respective compressor. For example, the control system can be configured to independently vary the vane or nozzle position of the exhaust gas turbines 124 and 134 via respective actuators.

Exhaust gases in first parallel exhaust passage 17 may be directed to the atmosphere via branched parallel exhaust passage 170 while exhaust gases in second parallel exhaust passage 19 may be directed to the atmosphere via branched parallel exhaust passage 180. Exhaust passages 170 and 180 may include one or more exhaust after-treatment devices, such as a catalyst, and one or more exhaust gas sensors.

Engine 10 may further include one or more exhaust gas recirculation (EGR) passages, or loops, for recirculating at least a portion of exhaust gas from the exhaust manifold to the intake manifold. These may include high-pressure EGR loops for proving high-pressure EGR (HP-EGR) and low-pressure EGR-loops for providing low-pressure EGR (LP-EGR). In one example, HP-EGR may be provided in the absence of boost provided by turbochargers 120, 130, while LP-EGR may be provided in the presence of turbocharger boost and/or when exhaust gas temperature is above a threshold. In still other examples, both HP-EGR and LP-EGR may be provided simultaneously.

In the depicted example, engine 10 may include a low-pressure EGR loop 202 for recirculating at least some exhaust gas from the first branched parallel exhaust passage 170, downstream of the turbine 124, to the first parallel intake passage 142, upstream of the compressor 122. In some embodiments, a second low-pressure EGR loop (not shown) may be likewise provided for recirculating at least some exhaust gas from the second branched parallel exhaust passage 180, downstream of the turbine 134, to the second parallel intake passage 144, upstream of the compressor 132. LP-EGR loop 202 may include LP-EGR valve 204 for controlling an EGR flow (i.e., an amount of exhaust gas recirculated) through the loops, as well as an EGR cooler 206 for lowering a temperature of exhaust gas flowing through the EGR loop before recirculation into the engine intake. Under certain conditions, the EGR cooler 206 may also be used to heat the exhaust gas flowing through LP-EGR loop 202 before the exhaust gas enters the compressor to avoid water droplets impinging on the compressors.

Engine 10 may further include a first high-pressure EGR loop 208 for recirculating at least some exhaust gas from the first parallel exhaust passage 17, upstream of the turbine 124, to intake manifold 160, downstream of intake throttle 158. Likewise, the engine may include a second high-pressure EGR loop (not shown) for recirculating at least some exhaust gas from the second parallel exhaust passage 18, upstream of the turbine 134, to the second branched parallel intake passage 148, downstream of the compressor 132. EGR flow through HP-EGR loops 208 may be controlled via HP-EGR valve 210.

A PCV port 102 may be configured to deliver crankcase ventilation gases (blow-by gases) to the engine intake manifold along second parallel intake passage 144. In some embodiments, flow of PCV air through PCV port 102 may be controlled by a dedicated PCV port valve. Likewise, a purge port 104 may be configured to deliver purge gases from a fuel system canister to the engine intake manifold along passage 144. In some embodiments, flow of purge air through purge port 104 may be controlled by a dedicated purge port valve.

Humidity sensor 232 and pressure sensor 234 may be included in only one of the parallel intake passages (herein, depicted in the first parallel intake air passage 142 but not in the second parallel intake passage 144), downstream of EGR throttle valve 230. Specifically, the humidity sensor and the pressure sensor may be included in the intake passage not receiving the PCV or purge air. Humidity sensor 232 may be configured to estimate a relative humidity of the intake air. In one embodiment, humidity sensor 232 is a UEGO sensor configured to estimate the relative humidity of the intake air based on the output of the sensor at one or more voltages. Since purge air and PCV air can confound the results of the humidity sensor, the purge port and PCV port are positioned in a distinct intake passage from the humidity sensor. Pressure sensor 234 may be configured to estimate a pressure of the intake air. In some embodiments, a temperature sensor may also be included in the same parallel intake passage, downstream of the EGR throttle valve 230.

As such, intake oxygen sensor 172 may be used for estimating an intake oxygen concentration and inferring an amount of EGR flow through the engine based on a change in the intake oxygen concentration upon opening of the EGR valve 204. Specifically, a change in the output of the sensor upon opening the EGR valve is compared to a reference point where the sensor is operating with no EGR (the zero point). Based on the change (e.g., decrease) in oxygen amount from the time of operating with no EGR, an EGR flow currently provided to the engine can be calculated. For example, upon applying a reference voltage (Vs) to the sensor, a pumping current (Ip) is output by the sensor. The change in oxygen concentration may be proportional to the change in pumping current (delta Ip) output by the sensor in the presence of EGR relative to sensor output in the absence of EGR (the zero point). Based on a deviation of the estimated EGR flow from the expected (or target) EGR flow, further EGR control may be performed. A zero point estimation of the intake oxygen sensor may be performed during idle conditions where intake pressure fluctuations are minimal and when no PCV or purge air is ingested into the low pressure induction system. In addition, the idle adaptation may be performed periodically, such as at every first idle following an engine start, to compensate for the effect of sensor aging and part-to-part variability on the sensor output.

A zero point estimation of the intake oxygen sensor may alternatively be performed during engine non-fueling conditions, such as during a deceleration fuel shut off (DFSO). By performing the adaptation during DFSO conditions, in addition to reduced noise factors such as those achieved during idle adaptation, sensor reading variations due to EGR valve leakage can be reduced.

Returning to FIG. 1, the position of intake and exhaust valves of each cylinder 14 may be regulated via hydraulically actuated lifters coupled to valve pushrods, or via a direct acting mechanical bucket system in which cam lobes are used. In this example, at least the intake valves of each cylinder 14 may be controlled by cam actuation using a cam actuation system. Specifically, the intake valve cam actuation system 25 may include one or more cams and may utilize variable cam timing or lift for intake and/or exhaust valves. In alternative embodiments, the intake valves may be controlled by electric valve actuation. Similarly, the exhaust valves may be controlled by cam actuation systems or electric valve actuation.

Engine system 100 may be controlled at least partially by a control system 15 including controller 12 and by input from a vehicle operator via an input device (not shown). Control system 15 is shown receiving information from a plurality of sensors 16 (various examples of which are described herein) and sending control signals to a plurality of actuators 81. As one example, sensors 16 may include humidity sensor 232, intake air pressure sensor 234, MAP sensor 182, MCT sensor 183, TIP sensor 174, and intake air oxygen sensor 172. In some examples, common intake passage 149 may further include a throttle inlet temperature sensor for estimating a throttle air temperature (TCT). In other examples, one or more of the EGR passages may include pressure, temperature, and air-to-fuel ratio sensors, for determining EGR flow characteristics. As another example, actuators 81 may include fuel injector 166, HP-EGR valves 210, LP-EGR valves 204, throttle valves 158 and 230, and wastegates 128, 138. Other actuators, such as a variety of additional valves and throttles, may be coupled to various locations in engine system 100. Controller 12 may receive input data from the various sensors, process the input data, and trigger the actuators in response to the processed input data based on instruction or code programmed therein corresponding to one or more routines. Example control routines are described herein with regard to FIGS. 4-5.

Now turning to FIG. 2, another example embodiment 200 of the engine of FIG. 1 is shown. As such, components previously introduced in FIG. 1 are numbered similarly and not re-introduced here for reasons of brevity.

Embodiment 200 shows a fuel tank 218 configured to deliver fuel to engine fuel injectors. A fuel pump (not shown) immersed in fuel tank 218 may be configured to pressurize fuel delivered to the injectors of engine 10, such as to injector 166. Fuel may be pumped into the fuel tank from an external source through a refueling door (not shown). Fuel tank 218 may hold a plurality of fuel blends, including fuel with a range of alcohol concentrations, such as various gasoline-ethanol blends, including E10, E85, gasoline, etc., and combinations thereof. A fuel level sensor 219 located in fuel tank 218 may provide an indication of the fuel level to controller 12. As depicted, fuel level sensor 219 may comprise a float connected to a variable resistor. Alternatively, other types of fuel level sensors may be used. One or more other sensors may be coupled to fuel tank 218 such as a fuel tank pressure transducer 220 for estimating a fuel tank pressure.

Vapors generated in fuel tank 218 may be routed to fuel vapor canister 22, via conduit 31, before being purged to engine intake 23. These may include, for example, diurnal and refueling fuel tank vapors. The canister may be filled with an appropriate adsorbent, such as activated charcoal, for temporarily trapping fuel vapors (including vaporized hydrocarbons) generated in the fuel tank. Then, during a later engine operation, when purge conditions are met, such as when the canister is saturated, the fuel vapors may be purged from the canister into the engine intake by opening canister purge valve (CPV) 112 and canister vent valve 114.

Canister 22 includes a vent 27 for routing gases out of the canister 22 to the atmosphere when storing, or trapping, fuel vapors from fuel tank 218. Vent 27 may also allow fresh air to be drawn into fuel vapor canister 22 when purging stored fuel vapors to engine intake 23 via purge lines 90 or 92 (depending on boost level) and purge valve 112. While this example shows vent 27 communicating with fresh, unheated air, various modifications may also be used. Vent 27 may include a canister vent valve 114 to adjust a flow of air and vapors between canister 22 and the atmosphere. The vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister.

Fuel vapors released from canister 22, for example during a purging operation, may be directed into engine intake manifold 160 via purge line 28. The flow of vapors along purge line 28 may be regulated by canister purge valve 112, coupled between the fuel vapor canister and the engine intake. The quantity and rate of vapors released by the canister purge valve 112 may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. The duty cycle may include a frequency (e.g., rate) of opening and closing the canister purge valve 112.

An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 182 coupled to intake manifold 160, and communicated with controller 12. Alternatively, MAP may be inferred from alternate engine operating conditions, such as mass air flow (MAF), as measured by a MAF sensor coupled to the intake manifold.

Purge hydrocarbons may be directed to intake manifold 160 via either a boost path 92 or a vacuum path 90 based on engine operating conditions. Specifically, during conditions when turbocharger 120 is operated to provide a boosted aircharge to the intake manifold, the elevated pressure in the intake manifold causes one-way valve 94 in the vacuum path 90 to close while opening one-way valve 96 in the boost path 92. As a result, purge air is directed into the air intake passage 140, downstream of air filter 156 and upstream of charge air cooler 154 via the boost path 92. Herein, the purge air is introduced upstream of intake oxygen sensor 172. In some embodiments, as depicted, a venturi 98 may be positioned in the boost path such that the purge air is directed to the intake upon passing through the venturi and passage 99. This allows the flow of purge air to be advantageously harnessed for vacuum generation.

During conditions when engine 10 is operated without boost, elevated vacuum in the intake manifold causes one-way valve 94 in the vacuum path to open while closing one-way valve 96 in the boost path. As a result, purge air is directed into the intake manifold 160, downstream of throttle 158 via the vacuum path 90. Herein, the purge air is introduced downstream of intake oxygen sensor 172.

PCV hydrocarbons may also be directed to intake manifold 160 via either a boost side PCV hose 252 or a vacuum side PCV hose 254 based on engine operating conditions. Specifically, blow-by gases from engine cylinders 14 flow past the piston rings and enter crankcase 255. During conditions when turbocharger 120 is operated to provide a boosted aircharge to the intake manifold, the elevated pressure in the intake manifold causes one-way valve 256 in vacuum side PCV hose 254 to close. As a result, during boosted engine operation, PCV gases flow in a first direction (arrow 264) and are received in the engine intake upstream of the intake oxygen sensor 172. Specifically, PCV air is directed into the air intake passage 140, downstream of air filter 156 and upstream of charge air cooler 154 via boost side PCV hose 252. The PCV flow may be directed to the intake passage upon passage through a boost side oil separator 260. The boost side oil separator may be integrated into the cam cover or may be an external component. Thus, during boosted conditions, the PCV gases are introduced upstream of intake oxygen sensor 172 and therefore do affect the output of oxygen sensor 172. The boosted conditions may include intake manifold pressure above ambient pressure.

In comparison, during conditions when engine 10 is operated without boost, elevated vacuum in the intake manifold causes one-way valve 256 in the vacuum side PCV hose 254 to open. As a result, during non-boosted engine operating, PCV gases flow in a second direction (arrow 262) different from the first direction and are received in the engine intake downstream of the intake oxygen sensor. In the depicted example, the second direction of PCV flow during non-boosted engine operation is opposite of the first direction of PCV flow during boosted engine operation (compare arrows 262 and 264). Specifically, during non-boosted operation, PCV air is directed into the intake manifold 160, directly, downstream of throttle 158 via the vacuum side PCV hose 254. The PCV flow may be directed to the intake manifold 160 upon passage through a vacuum side oil separator 258. Herein, the PCV air is introduced downstream of intake oxygen sensor 172, and therefore does not affect the output of oxygen sensor 172. Thus, due to the specific engine configuration, during boosted engine operation, PCV and purge air hydrocarbons are ingested into the engine intake manifold upstream of the intake oxygen sensor and are ingested into the engine intake manifold downstream of the intake oxygen sensor during non-boosted conditions.

Thus the systems of FIGS. 1-2 provide for an engine system, comprising an engine including an intake manifold, a crankcase coupled to the intake manifold via a PCV valve, a turbocharger with an intake compressor, an exhaust turbine, and a charge air cooler, an intake throttle coupled to the intake manifold downstream of the charge air cooler, a canister configured to receive fuel vapors from a fuel tank, the canister coupled to the intake manifold via a purge valve, an EGR system including a passage for recirculating exhaust residuals from downstream of the turbine to upstream of the compressor via an EGR valve, an intake oxygen sensor coupled to the intake manifold, downstream of the charge air cooler and upstream of the intake throttle, and a controller with computer readable instructions for: learning a correction factor for the intake oxygen sensor based on purge flow from the canister and adjusting a position of the EGR valve based on an output of the intake oxygen sensor relative to the correction factor. Learning the correction factor includes determining a change in intake oxygen at the intake oxygen sensor during modulating a position of the purge valve, the modulating occurring when the engine is boosted, purge is enabled, and EGR is flowing below a threshold, and the modulating including adjusting the purge valve position between an open and closed position at a set rate, the set rate determined based on operating conditions in one example. In one example, the purge valve modulation includes adjusting the purge valve position between a fully open and fully closed position, without stopping at other positions therebetween, at a predetermined frequency.

In one example, the correction factor may be a change in intake oxygen due to purge vapors alone. In another example, the correction factor may be based on an estimated purge flow rate, the estimated purge flow rate determined based on the change in intake oxygen due to purge flow at the current boost level. The computer readable instructions may further include instructions for estimating purge flow based on the change in intake oxygen during modulating the position of the purge valve, the change in intake oxygen being a change in measured intake oxygen between a first output of the intake oxygen sensor when the purge valve is open and a second output of the intake oxygen sensor when the purge valve is closed.

As previously discussed, the intake air oxygen sensor can be used to measure the amount of EGR in the intake aircharge as a function of the amount of change in oxygen content due to the addition of EGR as a diluent. Thus, as more EGR is introduced, the sensor may output a reading or pumping current corresponding to a lower oxygen concentration. During the estimation, a nominal reference voltage (e.g., at 450 mV), or Nernst voltage, is applied to the sensor and an output (e.g., a pumping current output by the sensor upon application of the lower reference voltage) is noted. Based on the output of the sensor relative to a zero point (or reference point) of the sensor (that is, sensor output at no EGR conditions), a change in oxygen concentration is learned, and an intake dilution with EGR is inferred.

However, if the EGR estimation is performed during conditions when purging and/or crankcase ventilation is enabled, an output of the sensor is corrupted. As such, purge air and/or positive crankcase ventilation hydrocarbons may be ingested during boosted engine operating conditions along boost path 92 and boost side PCV hose 252 when purge valve 112 is open and/or PCV valve 256 is closed. The sensor output may be corrupted primarily due to the ingested hydrocarbons reacting with ambient oxygen at the sensing element of the intake sensor. This reduces the (local) oxygen concentration read by the sensor. Since the output of the sensor and the change in oxygen concentration is used to infer an EGR dilution of intake aircharge, the reduced oxygen concentration read by the intake oxygen sensor in the presence of purge air and/or PCV may be incorrectly interpreted as additional diluent. This impacts the EGR estimation and the subsequent EGR control. Specifically, EGR may be over-estimated.

FIG. 3 depicts this variation in the reading of the intake sensor. Specifically, map 300 depicts an oxygen concentration estimated by an intake manifold oxygen sensor along the y-axis and a purge hydrocarbon (HC) content along the x-axis at a given EGR level. As the amount of purge HCs ingested into the low pressure induction system increases, such as when a purge valve is enabled during purging conditions, the hydrocarbons react with oxygen at the sensing element of the intake oxygen sensor. The oxygen is consumed and water and carbon dioxide is released. As a result, the estimated oxygen concentration is reduced, even though an amount of EGR flow may remain constant. This reduction in oxygen concentration estimated by the oxygen sensor may be inferred as an increased dilution (or replacement of oxygen with EGR). Thus, the controller may infer that there is a larger amount of EGR flow available than actually is present (e.g., the controller overestimates EGR). If not corrected for the hydrocarbon effect, a controller may decrease EGR flow in response to an incorrect indication of higher EGR dilution, degrading EGR control. For example, during purge and/or PCV flow conditions resulting in EGR over-estimation, the controller may decrease an opening of the EGR valve in response to a higher EGR estimate (based on a lower intake oxygen measurement from the intake oxygen sensor). However, actual EGR may be lower than the estimated level. Thus, EGR flow may be incorrectly reduced instead of maintained or increased. This may, in turn, result in increased engine emissions and/or degraded fuel economy and/or engine performance.

As such, it will be appreciated that purge hydrocarbons flow into the intake manifold (directly) during non-boosted conditions. Consequently, during non-boosted conditions, the purge flow is received downstream of the intake oxygen sensor and therefore do not confound the sensor results. However during boosted condition, the purge flow is received in the low pressure air induction system, upstream of the intake oxygen sensor. As a result, during the boosted conditions only, the sensor output is confounded by the purge flow.

In one example, adjusting an intake oxygen measurement based on purge flow may increase the accuracy of EGR flow estimates. Specifically, under certain engine operating conditions, an engine controller (such as controller 12 shown in FIG. 1) may determine a purge flow contribution to the intake oxygen concentration measured at an intake oxygen sensor (such as the intake oxygen sensor 172 shown in FIGS. 1-2). If the purge flow effect on intake oxygen under boosted conditions is known, the controller may use this to correct the measured intake oxygen used to estimate EGR flow. As such, the EGR estimate may be corrected based on purge flow.

As discussed above, purge flow may only be enabled (e.g., flowing) during boosted conditions (e.g., wherein intake air is being boosted by the turbocharger). During engine operating conditions when EGR is enabled (e.g., EGR valve is open and/or EGR is flowing) and purge is enabled (e.g., purge valve is open), the amount of purge flow and the impact of the purge flow on the intake oxygen sensor output may be determined. Specifically, during these conditions, intake oxygen may be measured by the intake oxygen sensor (IAO2) while the controller modulates the fuel canister purge valve (CPV). Modulating the CPV may include opening and closing the CPV at a set frequency. A change in the intake oxygen measurement during the modulating may be due to the changing purge flow. For example, fast changes in the intake oxygen measurement (and the EGR estimate) may be interpreted as changes due to purge and not due to changing EGR flow. A difference between the intake oxygen sensor output with the CPV open and CPV closed may be the change in intake oxygen due to purge flow. This change in intake oxygen due to purge flow may be converted to equivalent hydrocarbons to determine the estimated purge flow.

The change in intake oxygen due to purge flow may then be used to adjust the EGR flow estimates (from the intake oxygen sensor output). For example, during engine operation with EGR flowing, the controller may obtain an intake oxygen measurement from the intake oxygen sensor. A difference between a reference point (e.g., zero point) and the intake oxygen measurement then represents a total change in intake oxygen due to system diluents (EGR and purge). The previously determined change in intake oxygen due to purge may then be subtracted from the total change in intake oxygen to determine an actual change in intake oxygen due to EGR. This value may then be used to estimate EGR flow.

In addition to correcting EGR estimates, the estimated purge flow may be used to monitor and adjust the fuel canister purge system and adjust fueling to the engine. For example, as the estimated purge flow increases, the controller may decrease fueling to the engine. In this way, the controller may adjust fuel injection based on purge flow estimates. Methods for determining a change in intake oxygen resulting from purge flow and estimating EGR and purge flow based on the change in intake oxygen from purge flow are discussed further below with reference to FIGS. 4-5.

In this way, a method for an engine comprises during boosted engine operation with exhaust gas recirculation (EGR) flowing below a first threshold, modulating a canister purge valve (CPV) and estimating a purge flow rate based on an output of an intake oxygen sensor responsive to the modulating, the first threshold based on a response time of the CPV. In another example, if the response time of the CPV is over an upper threshold, transport of purge flow from the CPV to the intake oxygen sensor may be delayed. Specifically, there may be a transport delay between when purge flow exits the CPV and flows toward to intake oxygen sensor and when the purge flow arrives at the oxygen sensor. Thus, there may be a time lag between when the CPV is opened and when the purge flow reaches and is measure by the oxygen sensor. Thus, the purge flow rate may be further based on a known or estimated transport delay resulting from a travel distance between the CPV and the intake oxygen sensor. In some examples, the engine controller may correct an output of the oxygen sensor during the modulating based on the known or estimated transport delay.

The EGR flowing below a first threshold includes at least some EGR flow (e.g., greater than a minimum flow threshold). The response time of the CPV may include a frequency of switching between open and closed states of the CPV, and/or an amount of time it takes for the CPV to move from the open to the closed position. As such, the modulating may include opening and closing the CPV at a frequency, the frequency based on a canister load and a sensitivity of the intake oxygen sensor. The estimating of the purge flow rate responsive to the modulating may include determining the purge flow rate knowing the modulation frequency and comparing an amplitude of the intake oxygen sensor modulation that occurs during the modulating of the CPV, the amplitude at a frequency related to the modulation frequency (e.g., at the modulation frequency).

In one example, the method further comprises decreasing the EGR to below the first threshold and modulating the CPV in response to one or more of a duration since a previous purge flow estimation or EGR flow below a second threshold, the first threshold further based on the frequency of modulating the CPV. In another example, the method further comprises decreasing the EGR from a first level above the first threshold to a second level below the first threshold prior to modulating the CPV.

In one example, estimating the purge flow rate includes comparing a first output of the intake oxygen sensor with the CPV open and a second output of the intake oxygen sensor with the CPV closed. In another example, estimating the purge flow rate includes determining a change in intake oxygen measured by the intake oxygen sensor during the modulating and converting the change in intake oxygen to equivalent hydrocarbons to determine the purge flow rate.

EGR flowing may include flowing exhaust gas through a low pressure EGR system, the low pressure EGR system coupled between an exhaust passage downstream of a turbine and an intake passage upstream of a compressor. In another example, EGR flowing includes EGR flowing at a flat EGR schedule wherein EGR flow rate (e.g., EGR fraction) is relatively constant.

The method further comprises adjusting engine fueling based on the estimated PCV flow, the engine fueling decreased as the estimated PCV flow increases. Additionally, the method includes adjusting an EGR valve based on the output of the intake oxygen sensor during the modulating. Further, the method may include storing the estimated purge flow rate as a function of boost pressure and/or canister load in a look-up table in a memory of a controller. The method may then include during subsequent boosted engine operation with EGR flowing above the first threshold, adjusting an EGR valve based on an output of the intake oxygen sensor and a previously stored purge flow rate.

Figure 4:
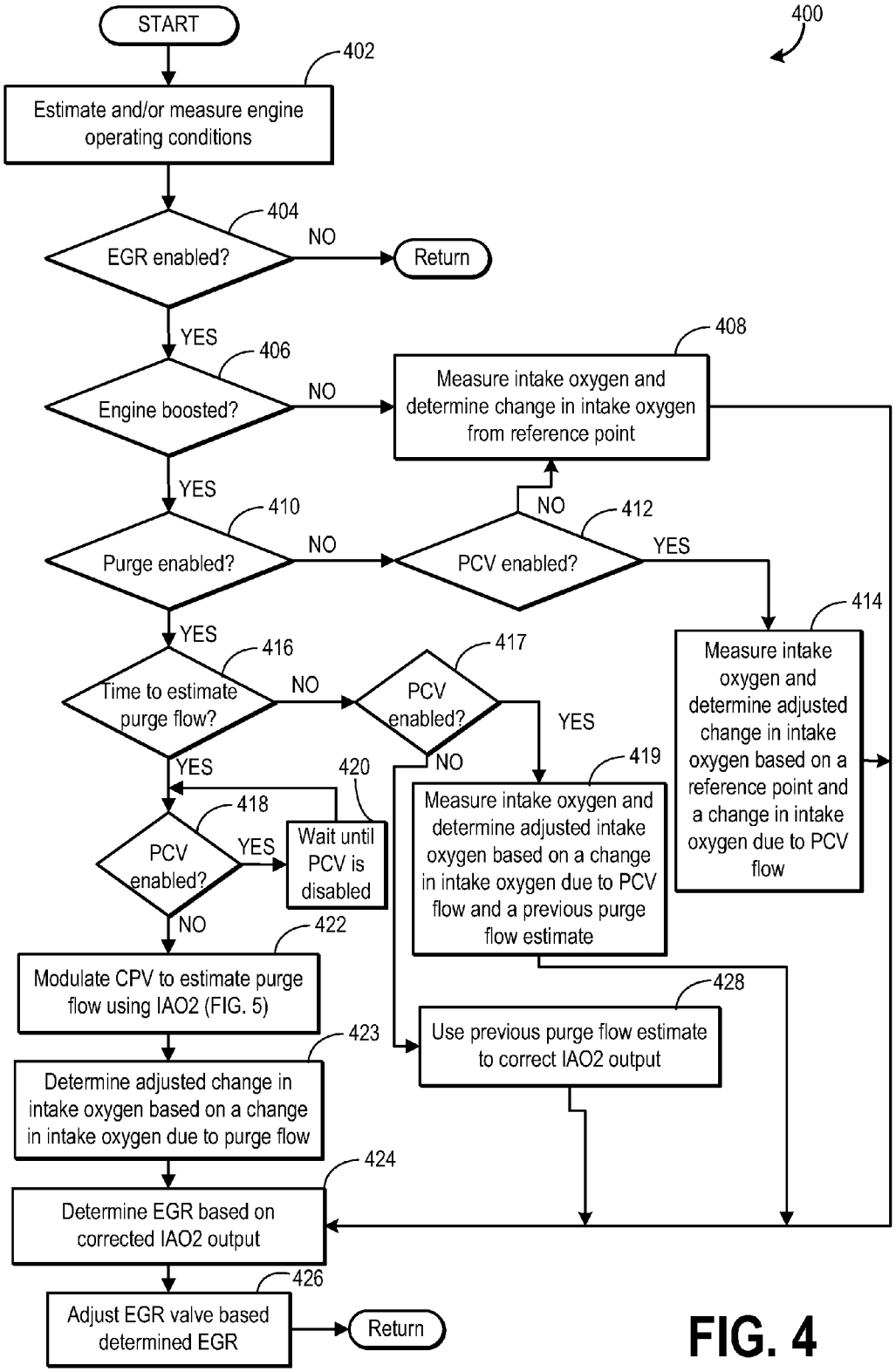
FIG. 4 is a flow chart for adjusting EGR operation based on a change in intake oxygen due to purge flow.

Now turning to FIG. 4, a method 400 is shown for adjusting EGR operation based on a change in intake oxygen due to purge flow. As described above, when EGR is flowing, an EGR estimate based on measured intake oxygen may be adjusted (e.g., corrected) based on the contribution of purge flow to an overall change in intake oxygen from a reference point. As a result, a more accurate EGR flow estimate may be determined, thereby resulting in increased EGR system control and reduced emissions. As described above, in one example, intake oxygen may be measured by an intake oxygen sensor, such as intake oxygen 172 shown in FIGS. 1-2. Instructions for executing method 400 may be stored in a memory of a controller of the engine, such as controller 12 shown in FIG. 1.

The method begins at 402 by estimating and/or measuring engine operating conditions. In one example, engine operating conditions may include engine speed and load, torque demand, MAF, MAP, EGR, a position of an EGR valve, a PCV valve, and fuel canister purge valve (CPV), boost, engine dilution required, engine temperature, BP, etc. At 404, the method includes determining if EGR is enabled. As discussed above, EGR may be enabled if the EGR valve is at least partially open with EGR flowing through the low pressure EGR passage and into the engine intake. If EGR is not enabled (e.g., the EGR valve is in a closed position and EGR is not flowing), the method returns. Alternatively, if EGR is enabled at 404, the method proceeds to 406 to determine if the engine is boosted. In one example, determining if the engine is boosted may include determining if MAP is greater than the compressor inlet pressure (CIP).

If the engine is not boosted (e.g., also referred to as a non-boosted condition where MAP is less than CIP), the method continues on to 408 to measure the intake oxygen concentration with the intake oxygen sensor and determine the change in intake oxygen from the reference point. First, the intake oxygen sensor may measure the intake oxygen. The method at 408 may then include subtracting the intake oxygen measurement (e.g., the output from the intake oxygen sensor) from a reference point. As discussed above, the reference point may be a pre-determined point when the sensor was operating with no EGR (the zero point). Thus, the resulting value may be a total change in intake oxygen (at the intake oxygen sensor) due to diluents in the air flow (e.g., aircharge). Since the engine is not boosted, even if purge flow is enabled, it would be injected downstream from the intake oxygen sensor, therefore not affecting the sensor measurement. Thus, in this case, the diluents in the aircharge at 408 may only be EGR (or majorly only EGR) and not hydrocarbons from purge flow. The method may then continue on to 424 to estimate EGR from the total change in intake oxygen, as described further below.

If the engine is boosted at 406, the method continues on to 410 to determine is fuel canister purging is enabled. As introduced above, a fuel vapor canister (such as fuel vapor canister 22 shown in FIG. 2) may be purged when a canister load is higher than a threshold, the engine is running, and a purge valve is open. As such, if purge air is received in the intake aircharge when the engine is boosted, purge hydrocarbons (HCs) may be ingested along with exhaust residuals in the EGR. These hydrocarbons may react with oxygen at the sensing element of the intake oxygen sensor, generating carbon dioxide and water. The resulting lowering of oxygen concentration leads to a misrepresentation of engine dilution.

If purge is not enabled at 410, the method continues on to 412 to determine if PCV flow is enabled. PCV may be enabled when the engine is operating boosted and a PCV valve is open. As discussed above, if PCV is enabled, PCV hydrocarbons (HCs) may be ingested, along with exhaust residuals in the EGR, into the intake aircharge. These hydrocarbons may react with oxygen at the sensing element of the intake oxygen sensor, generating carbon dioxide and water. The resulting lowering of oxygen concentration leads to a misrepresentation of engine dilution and inaccurate EGR flow estimation. Thus if PCV is enabled, the method continues on to 414 to measure the intake oxygen at the intake oxygen sensor and determine an adjusted change in intake oxygen based on a reference point and a change in intake oxygen due to PCV flow (e.g., a PCV correction factor). In one example, the PCV correction factor may be determined based on a change in intake oxygen sensor output between boosted and non-boosted engine operation when EGR and purge flow are disabled. In this way, an intake oxygen measurement may be corrected for PCV flow when purge is disabled. However, when purge is enabled, a previously determined correction factor for purge (e.g., change in intake oxygen due to purging of fuel canister) may also be applied to the intake oxygen sensor reading to determine the change in intake oxygen due to EGR, as discussed below at 419. Alternatively, if PCV flow is not enabled at 412, the method continues on to 408 to measure the intake oxygen concentration with the intake oxygen sensor and determine the change in intake oxygen from the reference point (without correction the sensor output based on PCV and purge flow).

Returning to 410, if purge is enabled, the method continues on to 416 to determine if it is time to estimate purge flow (e.g., estimate the amount of purge flow and/or purge flow rate into the intake, upstream of the intake oxygen sensor). A method for estimating purge flow while EGR and purge are both enabled is presented at FIG. 5 and includes modulating the CPV to estimate purge flow using the intake oxygen sensor output. In one example, purge flow estimation may occur after a duration of engine operation (e.g., a number of engine cycles or amount of time of engine operation) and/or a distance of vehicle travel (e.g., number of miles traveled). In this way, purge flow estimation may occur at a set time schedule. In another example, purge flow estimation may only occur if EGR flow is below a first threshold. The first threshold may be based on a second threshold in which EGR must be decreased to during the purge flow estimation. For example, purge flow estimation may only occur if EGR is already below the second threshold and/or within a threshold of the EGR flow rate that EGR must be reduced to during the estimation. In yet another example, purge flow estimation may only occur if EGR is below the second threshold and/or EGR is flowing at a flat EGR schedule (e.g., EGR flow is relatively constant and not changing). Thus, the controller may determine it is time to estimate purge flow via the method presented at FIG. 5 if the set duration has passed and/or if EGR is below the first threshold.

If it is time to execute the purge flow estimation routine, the method continues on to 418 to determine if PCV flow is enabled (e.g., the PCV valve is open, as discussed above). In the presence of PCV, the controller may not be able to distinguish the effect on purge hydrocarbons on the oxygen sensor relative to those of PCV hydrocarbons. Thus, if PCV is enabled at 418, the method continues on to 420 to wait until the PCV valve closes, thereby indicating that PCV is disabled. Alternately, the method may close the PCV valve at 420 to permit the purge flow estimation to take place. In other words, purge flow estimation based on the intake oxygen sensor is only performed if there is no other diluent contribution in addition to the purge hydrocarbons and EGR.

If it is time to execute the purge flow estimation and PCV is disabled, the method continues on to 422 to modulate the CPV to estimate purge flow using the intake oxygen sensor. For example, the method at 422 may include modulating the CPV (e.g., opening and closing the CPV) at a set frequency (or pulse width) and continuously measuring the intake oxygen with the intake oxygen sensor during the modulating. A difference in the intake oxygen sensor output between the open and closed states of the CPV may be the change in intake oxygen due to purge flow. The method at 422 is shown in detail at FIG. 5, described further below.

After determining purge flow and the change in intake oxygen measured by the intake oxygen sensor due to the purge flow, the method continues on to 423. At 423 the method includes determining an adjusted change in intake oxygen based on the reference point and the change in intake oxygen due to purge flow and/or canister loading. Said another way, the intake oxygen sensor output may be adjusted based on the estimated purge flow (or adjusted by a purge flow correction factor). In one example, the method at 423 may include subtracting the change in intake oxygen due to purge flow from the total change in intake oxygen measured at the intake oxygen sensor (the total change in intake oxygen may be relative to the pre-determined reference point). In another example, the controller may store the change in intake oxygen due to purge flow as a function of boost level in a memory of the controller. Additionally or alternatively, the controller may store the change in intake oxygen due to purge flow as a function of canister load. During subsequent operation, the controller may then look-up the purge flow correction factor (e.g., change in intake oxygen due to purge flow) at the current boost level. The resulting value at 423 may be the measured change in intake oxygen due to EGR alone and not due to purge flow.

After determining the change in intake oxygen due to EGR only and no other diluents, the method continues on to 424 to determine EGR (e.g., the amount or flow rate of EGR) based on the corrected intake oxygen sensor output (e.g., the change in intake oxygen due to EGR). The method then continues on to 426 to adjust an EGR valve based on the determined EGR. For example, if the estimated EGR flow rate is greater than a desired EGR flow rate (based on engine operating conditions), the controller may reduce an opening of the EGR valve to reduce the EGR flow to the desired flow rate. In another example, if the estimated EGR flow is less than the desired EGR flow rate, the controller may increase the opening of the EGR valve to increase the EGR flow rate to the desired flow rate. In some examples, additional engine operating parameters may be adjusted based on the determined EGR flow. For example, spark timing, throttle angle, and/or fuel injection may be adjusted based on the determined EGR flow.

Returning to 416, if it is not time to estimate purge flow (or the engine is unable to estimate purge flow due to the EGR flow rate being above the first threshold), the method continues on to 417 to determine if PCV is enabled. If PCV is not enabled, the method continues to 428 to measure the intake oxygen using the intake oxygen sensor and then use a previously stored purge flow estimate to correct the intake oxygen sensor output. For example, as described above, the controller may adjust the change in intake oxygen measured by the intake oxygen sensor by a change in intake oxygen due to purge flow. The change in intake oxygen due to purge flow may be obtained from the look-up table as a function of the current boost level. After determining the adjusted change in intake oxygen due to EGR alone, the method continues on to 428.

However, if PCV is enabled, the controller continues on to 419 to measure the intake oxygen and determine an adjusted change in intake oxygen based on the reference point, a change in intake oxygen due to PCV flow, and the previously determined change in intake oxygen due to purge flow. As discussed at 414, the change in intake oxygen due to PCV flow may be determined using another method of estimating the effect of PCV on the intake oxygen sensor output. The method then continues on to 424 to determine EGR flow based on the adjusted change in intake oxygen.

Figure 5:
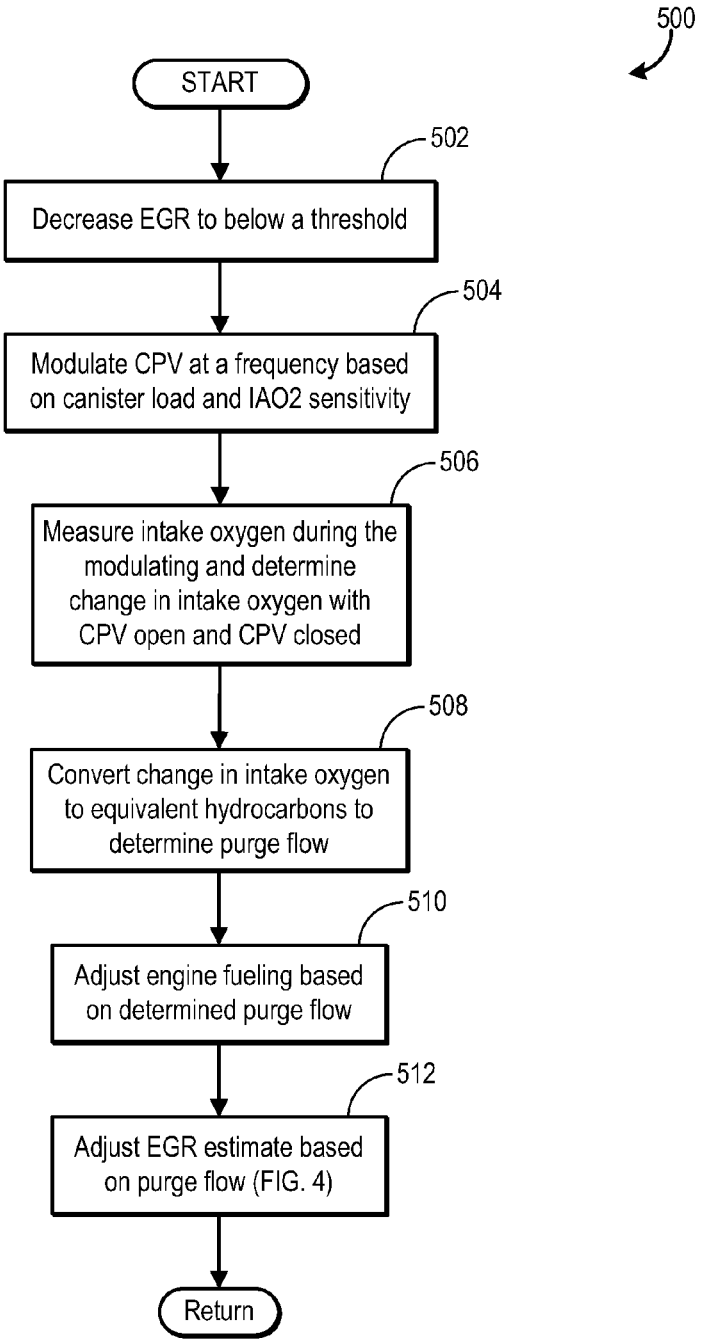
FIG. 5 is a flow chart for determining a change in intake oxygen resulting from fuel canister purge flow.
Figure 6:
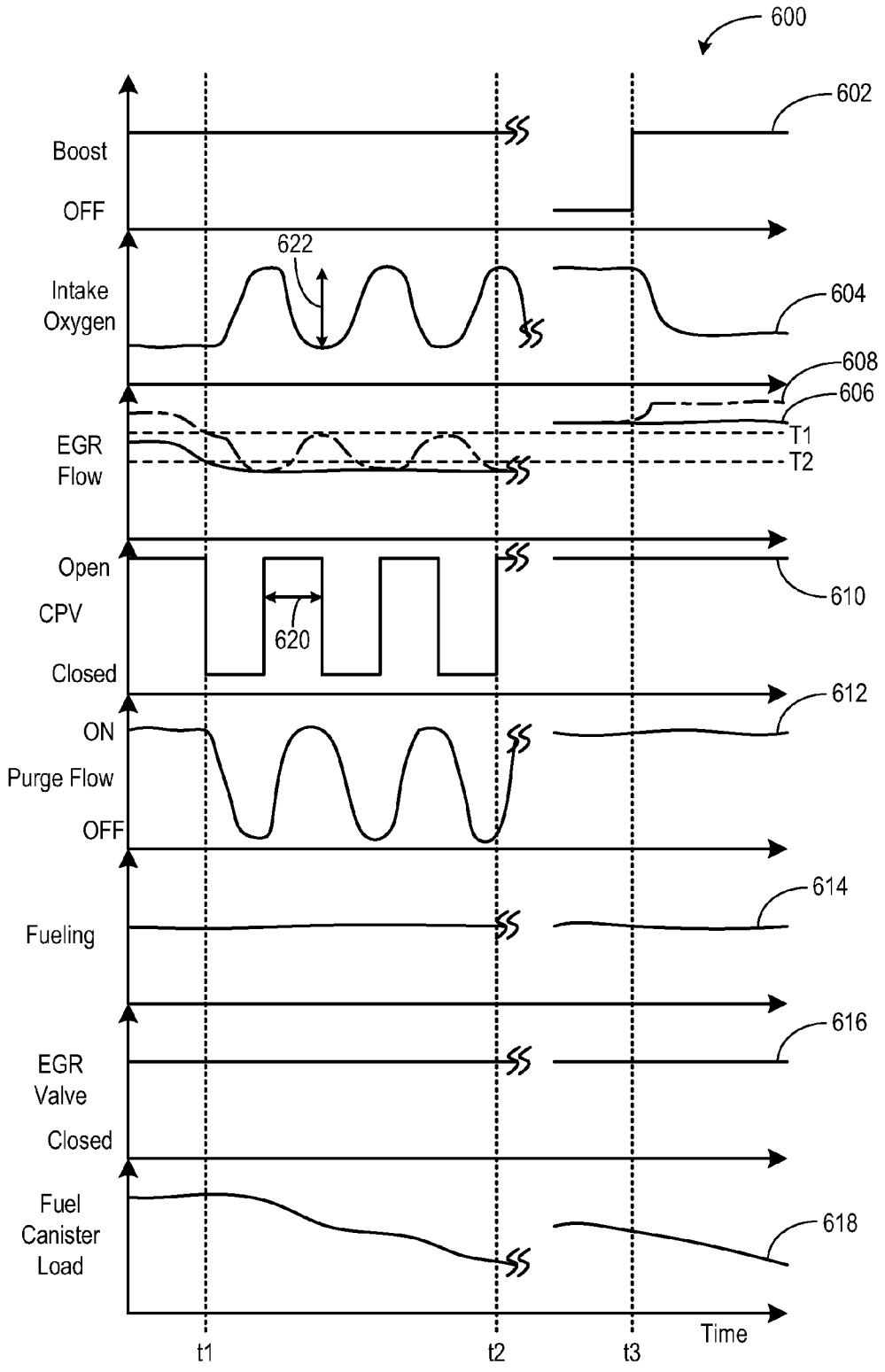
FIG. 6 is a graph of example adjustments to a fuel canister purge valve for determining purge flow with an intake oxygen sensor.

FIG. 5 shows a method 500 for determining a change in intake oxygen due to fuel canister purge flow. The method further includes estimating purge flow (e.g., an amount or flow rate of purge flow) based on the change in intake oxygen due to purge. Method 500 may be performed during method 400, as described above with reference to FIG. 4, when purge flow and EGR flow are both enabled. Further, method 500 may only be executed when the engine is boosted and the conditions for estimating purge flow are met. In one example, conditions for estimating purge flow may include a duration passing since the last purge flow estimation. In another example, the conditions for estimating purge flow may include EGR flow being below a first threshold. As such, method 500 may occur at step 422 in method 400, shown at FIG. 4.

Method 500 begins at 502 by decreasing EGR to below a threshold. In one example, the threshold may be a second threshold different than the first threshold for determining whether it is time to estimate purge flow. For example, the second threshold may be lower than the first threshold such that the EGR flow must be within a threshold (e.g., the difference between the firs and the second thresholds) of the second threshold in order to proceed with the purge flow estimation and decrease EGR flow below the second threshold. In another example, the first threshold and the second threshold may be substantially the same. The method at 502 may include decreasing EGR flow from a first demanded level to a lower second level, the second level being below the second threshold. The second threshold may be a threshold EGR flow rate or EGR amount, the second threshold based on a modulating frequency of the CPV (e.g., a rate of modulating the CPV). For example, the second threshold may be defined such that EGR flow is introduced into the intake aircharge at a rate slower than a response rate of the CPV (e.g., slower than the set modulating frequency or pulse width of the CPV).

At 504 the method includes modulating the CPV at a modulating frequency based on a canister load and a sensitivity of the intake oxygen sensor. As discussed above, the fuel vapors may be purged from a fuel canister by opening the CPV (e.g., CPV 112 shown in FIG. 2). When the engine is boosted, the purge flow enters the engine intake upstream of the intake oxygen sensor, thereby causing the sensor to measure a larger change (e.g., decrease) in intake oxygen compared to aircharge without vapors from the purge flow. Modulating the CPV includes opening and closing the CPV at a set frequency. In one example the modulating may include fully opening and fully opening the CPV at the set frequency. For example, the controller may set a pulse width proportional to the desired modulating frequency for opening and closing the CPV. In this way modulating may include pulse width modulating the CPV. As the CPV is modulated and fluctuates between open and closed positions, the intake oxygen of the aircharge measured by the intake oxygen sensor may change. Specifically, during the modulating, the sensor may measure large changes in intake oxygen. For example, when the CPV switches from being open to being closed, the measured intake oxygen may increase. Abrupt changes in the measured intake oxygen may be attributed to changing purge flow due to modulating the CPV. Further, the modulating frequency (or the pulse width set for the modulating) may be based on a sensitivity of the intake oxygen sensor and a fuel canister load. For example, as the fuel canister load increases, the pulse width may increase and the modulating frequency may decrease (e.g., longer duration between opening and closing of the CPV). Further, the pulse width must be short enough (and the frequency fast enough) so that the distinct measurement changes in intake oxygen are seen at the intake oxygen sensor but long enough that the intake oxygen sensor has time to distinctly measure the changes in intake oxygen. The modulating frequency may change during engine operation based on changing canister load.

The modulating may continue for a duration, the duration based on a number of samples required for determining the change in intake oxygen due to purge and subsequently estimating purge flow. In another example, the modulating may continue for a number of modulating cycles (e.g., a number of opening and closing events of the CPV). In yet another example, the modulating may continue until an engine operating parameter changes. For example, the modulating may continue until the engine switches from boosted to un-boosted operation or a desired EGR flow rate increases above the first threshold.

At 506, the method includes measuring the intake oxygen of the aircharge (e.g., intake air) with the intake oxygen sensor (e.g., intake oxygen sensor 172 shown in FIGS. 1-2) during the modulating the CPV and determining the change in intake oxygen with the CPV open and CPV closed. In one example, the method at 506 includes measuring the change in measured intake oxygen during the modulating. The change in intake oxygen may be an average change in intake oxygen read by the intake oxygen sensor during the modulating.

At 508, the controller may convert the change in intake oxygen due to purge flow (e.g., the change in intake oxygen between the open and closed states of the CPV) to equivalent hydrocarbons in order to determine a purge flow rate and/or amount of purge flow. Specifically, based on the change in oxygen concentration due to purge flow, an amount or concentration of hydrocarbons may be determined. This may then be used as an estimate of purge flow to the engine intake. The controller may store the change in intake oxygen due to purge flow and/or the corresponding purge flow rate (or amount) as a function of boost level. As discussed above, the controller may store the estimated purge flow in a look-up table at a boost level. Then, during subsequent engine operation, the controller may use previously determined (and stored) purge flow values to correct the intake oxygen sensor output for determining EGR flow.

In one example, the purge flow estimate may be used to monitor the fuel canister purge system and determine if the system is degraded. For example, changes in the intake oxygen sensor reading between open and closed CPV states below a threshold may be an indication that the purge flow system is not flowing as expected and may be blocked or have a disconnected hose or degraded valve. In another example, as shown at 510, the controller may adjust fueling to the engine based on the determined purge flow. For example, the controller may adjust the mass and/or volume of fuel delivered to engine cylinders. In one example, as the purge flow increases, fueling to the engine (e.g., the mass and/or volume of fuel delivered via fuel injectors) may be decreased. In one example, the amount of fuel coming from the purge flow is estimated by determining the amount of intake oxygen change due to purge flow and converting it to the amount of fuel vapor. The change in intake oxygen is converted to a mass of fuel assuming that the fuel in the purge flow is the same as the fuel type in the fuel in the injectors (e.g., the nominal stoichiometric air/fuel ratio of fuel in purge is assumed to be that of fuel in the injectors). In still other examples, a timing of fueling may also be adjusted.

At 512, the method includes adjusting an EGR flow estimate based on the estimated purge flow. The method at 512 may include adjusting a measured intake oxygen value (from the intake oxygen sensor) by the determined change in intake oxygen due to purge flow. EGR flow may then be determined based on the adjusted intake oxygen value. The resulting EGR flow estimate may be more accurate than just using the raw output of the intake oxygen sensor since the dilution effects from purge flow have been removed. The method at 512 is shown in further detail at step 424 in FIG. 4.

FIG. 6 shows a graphical example of modulating a canister purge valve (CPV) to determine a purge flow rate based on an output of an intake oxygen sensor during the modulating. Specifically, graph 600 shows changes in boost at plot 602, changes in intake oxygen at plot 604, changes in actual EGR flow at plot 606, changes in an uncorrected EGR flow at plot 608, changes in a position of a fuel canister purge valve (CPV) at plot 610, changes in purge flow at plot 612, changes in engine fueling at plot 614, changes in a position of an EGR valve at plot 616, and changes in fuel canister load (e.g., a level or amount of fuel vapors in the canister) at plot 618. The changes in intake oxygen shown at plot 604 may be measured by an intake oxygen sensor positioned in an intake system of an engine. As discussed above, in one example, the intake oxygen sensor is positioned in an intake manifold, upstream of an intake throttle, downstream of where EGR flow enters the intake system, and downstream of where purge flow enters the intake system when the engine is boosted.

Prior to time t1, the engine is boosted (plot 602), an EGR valve is at least partially open (plot 616), thereby resulting in EGR flowing (plot 606), and purge is enabled (e.g., the CPV is open). Further, actual EGR flow may between a first threshold T1 and a second threshold T2 (plot 606). During boosted operating when purge is enabled and flowing into the intake, the uncorrected EGR flow may be overestimated (plot 608), as shown by plot 608 being greater than plot 606. This may be due to purge flow introducing additional diluents in the air-charge, thereby decreasing intake oxygen measured at the intake oxygen sensor and the controller interpreting this decrease in intake oxygen to EGR alone and not additional diluents such as purge vapors. Instead, if a correction factor or the effect of purge flow on the output of intake oxygen sensor is learned, the controller may correct the output of the sensor by the correction factor when purge is enabled. As discussed above, this correction factor may be learned by modulating a position of the CPV while the engine is boosted, EGR is flowing, and purge is enabled.

Just before time t1, the controller may determine it is time to estimate purge flow. In one example, a duration may have passed since the last purge flow estimation. In another example, the controller may estimate purge flow responsive to the EGR flow being below the first threshold T1 during boosted engine operation when purge is enabled. As a result of deciding to estimate purge flow, the controller decreases EGR below the second threshold T2. Once EGR is decreased and held steady at a lower level below the second threshold T2, the controller may begin modulating the CPV. As discussed above, modulating the CPV includes opening and closing the CPV at a set frequency (e.g., rate), the frequency defining a pulse width at which the controller actuates the CPV. The pulse width of the modulation is shown at 620. In this way, the CPV is held open or closed for a duration equal to the pulse width and then the controller switches the positions of the CPV. Thus, as the modulating frequency increases, the pulse width decreases. As discussed above, the pulse width 620 may be based on a sensitivity of the intake oxygen sensor and the fuel canister load (618). In some examples, the pulse width may be set to a longer pulse width when the fuel canister load is at a higher level than if the fuel canister load is at a lower level.

As the controller modulates the CPV between time t1 and time t2, the intake oxygen measured at the intake oxygen sensor fluctuates (plot 604). Specifically, the intake oxygen fluctuates between a higher, first level when the CPV is closed (and purge flow is off) and a lower, second level when the CPV is open (and purge flow is on). The oscillation of the measured intake oxygen (plot 604) may be delayed (e.g., shifted in time) compared to purge flow (plot 612) due to transport delay between the CPV and the intake oxygen sensor. The difference between the intake oxygen at the first level and the second level may approximate the purge flow. Said another way, the change in intake oxygen 622 between the first level and the second level may be the change in intake oxygen due to purge flow. Thus, converting the change in intake oxygen 622 to equivalent hydrocarbons may result in the purge flow rate estimate (or purge amount estimate). By subtracting the change in intake oxygen 622 during the modulating from the intake oxygen sensor output while purge is enabled (CPV is open), the controller may determine an adjusted change in intake oxygen due to EGR alone and not due to purge flow. The adjusted change in intake oxygen is then used to determine the actual EGR flow (plot 606).

In one example, the controller may continue the modulating for a duration (e.g., between time t1 and time t2). The duration of modulating may be based on a number of samples required to determine the measured change in intake oxygen between the open and closed CPV positions. The controller may take an average of the change in intake oxygen over the duration of modulating in order to determine an average purge flow rate. The controller may then store the purge flow rate as a function of boost and use this (or the change in intake oxygen due to purge flow) to adjust and correct the output of the intake oxygen sensor during subsequent operation when the engine is boosted and purge is enabled.

After the duration of modulating is complete, the controller may return EGR to desired (e.g., requested) level. If purge is still enabled, the CPV may remain open to complete fuel canister purging. Further, the controller may go on to estimate EGR flow based on the output of the intake oxygen sensor and the determined purge flow and/or adjust fueling based on the determined purge flow.

After a duration of time has passed, the engine may be operating un-boosted (plot 602). Additionally before time t3, purge may be enabled with the CPV open (plot 610). EGR may also be enabled (plot 616) with the EGR flow rate above the first threshold T1 (plot 606 and plot 608). Since the engine is un-boosted, purge flow may enter the intake manifold, downstream of the intake oxygen sensor. Thus, both the actual EGR flow (plot 606) and the uncorrected EGR flow (plot 608) may be substantially the same since purge vapors are not adding to the diluent in the intake air at the intake oxygen sensor.

At time t3, boost is enabled (plot 602). As a result, purge vapors may flow into the intake upstream of the intake oxygen sensor, therefore resulting in a decrease in intake oxygen (plot 604) and an overestimate of EGR if the intake oxygen sensor output is not corrected based on purge flow (plot 608). Thus, at time t3, the controller may estimate the actual EGR (plot 606) based on the measured intake oxygen (plot 604) and a previously determined purge flow estimate. For example, the purge flow and change in intake oxygen due to purge determined between time t1 and time t2 may be used to correct the intake oxygen measured at time t3. The resulting EGR estimate may be the lower actual EGR flow rate (plot 606) instead of the overestimated and uncorrected EGR flow rate (plot 608).

As shown at FIG. 6, a method for an engine comprises: during a first condition (as shown at time t1) when an engine is boosted, fuel canister purge is enabled, and exhaust gas recirculation (EGR) is flowing below a first threshold, modulating a canister purge valve (CPV) and adjusting an EGR valve based on an output of an intake oxygen sensor during the modulating. During the first condition, the method includes decreasing EGR below a second threshold, the second threshold below the first threshold and the second threshold based on the pulse width.

The method further includes, during a second condition (as shown at time t3) when the engine is boosted, fuel canister purge is enabled, and EGR is flowing at or above the first threshold, not modulating the CPV and adjusting the EGR valve based on an output of the intake oxygen sensor and a stored purge flow estimate. Adjusting the EGR valve based on the stored purge flow estimate includes adjusting the EGR valve based on a purge flow estimate determined during previous engine operation during the first condition, the stored purge flow estimate stored in a memory of a controller.

Modulating the CPV includes pulse width modulating the CPV to open and close the CPV at a pulse width, the pulse width based on a fuel canister load and a sensitivity of the intake oxygen sensor, the pulse width increasing with increasing fuel canister load. The method further includes during a third condition when the engine is not boosted, adjusting the EGR valve based on the output of the intake oxygen sensor and not adjusting the output based on purge flow.

In this way, the output of the intake oxygen sensor may be corrected for purge flow. As described above, the intake oxygen sensor may be an intake manifold oxygen sensor positioned in the intake manifold of the engine. If the contribution to the change in intake oxygen due to purge flow is removed from the intake oxygen sensor output, the remaining value may be substantially equivalent to the change in intake oxygen due to EGR flow. This value may then be used to more accurately estimate EGR flow. In this way, a technical effect is achieved by adjusting EGR operation based on the estimated EGR flow, the estimated EGR flow based on a change in intake oxygen resulting from purge flow. As a result, EGR system control may increase and engine emissions and/or fuel economy may be maintained at desired levels. Additionally, engine fueling may be adjusted based on the purge flow estimated by the intake oxygen sensor, improving engine fuel economy, emissions and performance.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

during boosted engine operation with exhaust gas recirculation (EGR) flowing below a first threshold, modulating a canister purge valve (CPV); and estimating a purge flow rate based on an output of an intake oxygen sensor responsive to the modulating, the first threshold based on a response time of the CPV.

2. The method of claim 1, wherein the modulating includes opening and closing the CPV at a frequency, the frequency based on a canister load and a sensitivity of the intake oxygen sensor.

3. The method of claim 2, further comprising decreasing EGR to below the first threshold and modulating the CPV in response to one or more of a duration since a previous purge flow estimation or EGR flow below a second threshold, the first threshold further based on the frequency of modulating the CPV.

4. The method of claim 2, further comprising decreasing EGR from a first level above the first threshold to a second level below the first threshold prior to modulating the CPV.

5. The method of claim 1, wherein estimating the purge flow rate includes comparing a first output of the intake oxygen sensor with the CPV open and a second output of the intake oxygen sensor with the CPV closed and wherein the estimating is further based on a transport delay of purge flow between the CPV and the intake oxygen sensor.

6. The method of claim 1, wherein the estimating the purge flow rate includes determining a change in intake oxygen measured by the intake oxygen sensor during the modulating and converting the change in intake oxygen to equivalent hydrocarbons to determine the purge flow rate.

7. The method of claim 1, wherein EGR flowing includes flowing exhaust gas through a low pressure EGR system, the low pressure EGR system coupled between an exhaust passage downstream of a turbine and an intake passage upstream of a compressor.

8. The method of claim 1, wherein EGR flowing includes EGR flowing at a flat EGR schedule wherein an EGR fraction is relatively constant.

9. The method of claim 1, further comprising, adjusting engine fueling based on the estimated PCV flow, the engine fueling decreased as the estimated PCV flow increases.

10. The method of claim 1, further comprising adjusting an EGR valve based on the output of the intake oxygen sensor during the modulating.

11. The method of claim 1, further comprising storing the estimated purge flow rate as a function of one or more of boost pressure or canister load in a look-up table in a memory of a controller.

12. The method of claim 11, further comprising during subsequent boosted engine operation with EGR flowing above the first threshold, adjusting an EGR valve based on an output of the intake oxygen sensor and a previously stored purge flow rate.

13. An engine method, comprising:

during a first condition when an engine is boosted, fuel canister purge is enabled, and exhaust gas recirculation (EGR) is flowing below a first threshold, modulating a canister purge valve (CPV); and adjusting an EGR valve based on an output of an intake oxygen sensor during the modulating; and during a second condition when the engine is boosted, fuel canister purge is enabled, and EGR is flowing at or above the first threshold, not modulating the CPV; and adjusting the EGR valve based on an output of the intake oxygen sensor and a stored purge flow estimate.

14. The method of claim 13, wherein modulating the CPV includes pulse width modulating the CPV to open and close the CPV at a pulse width, the pulse width based on a fuel canister load and a sensitivity of the intake oxygen sensor, the pulse width increasing with increasing fuel canister load.

15. The method of claim 14, further comprising during the first condition, decreasing EGR below a second threshold, the second threshold below the first threshold and the second threshold based on the pulse width.

16. The method of claim 13, wherein adjusting the EGR valve based on the stored purge flow estimate includes adjusting the EGR valve based on a purge flow estimate determined during previous engine operation during the first condition, the stored purge flow estimate stored in a memory of a controller.

17. The method of claim 13, further comprising during a third condition when the engine is not boosted, adjusting the EGR valve based on the output of the intake oxygen sensor and not adjusting the output based on purge flow.

18. An engine system, comprising:

an engine including an intake manifold a crankcase coupled to the intake manifold via a PCV valve;

a turbocharger with an intake compressor, an exhaust turbine, and a charge air cooler;

an intake throttle coupled to the intake manifold downstream of the charge air cooler;

a canister configured to receive fuel vapors from a fuel tank, the canister coupled to the intake manifold via a purge valve;

an EGR system including a passage for recirculating exhaust residuals from downstream of the turbine to upstream of the compressor via an EGR valve;

an intake oxygen sensor coupled to the intake manifold, downstream of the charge air cooler and upstream of the intake throttle; and a controller with computer readable instructions for:

learning a correction factor for the intake oxygen sensor based on purge flow from the canister; and adjusting a position of the EGR valve based on an output of the intake oxygen sensor relative to the correction factor.

19. The system of claim 18, wherein learning the correction factor includes determining a change in intake oxygen at the intake oxygen sensor during modulating a position of the purge valve, the modulating occurring when the engine is boosted, purge is enabled, and EGR is flowing below a threshold, and the modulating including modulating the purge valve between an open and closed position at a set rate.

20. The system of claim 19, wherein the computer readable instructions further include instructions for estimating purge flow based on the change in intake oxygen during modulating the position of the purge valve, the change in intake oxygen being a change in measured intake oxygen between a first output of the intake oxygen sensor when the purge valve is open and a second output of the intake oxygen sensor when the purge valve is closed.

* * * * *